US010309179B2

(12) United States Patent
Glaser et al.

(10) Patent No.: US 10,309,179 B2
(45) Date of Patent: Jun. 4, 2019

(54) DOWNHOLE CASING PULLING TOOL

(71) Applicant: Weatherford Technology Holdings, LLC, Houston, TX (US)

(72) Inventors: Mark C. Glaser, Houston, TX (US); Richard J. Segura, Cypress, TX (US); Thomas D. Helbert, Magnolia, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 606 days.

(21) Appl. No.: 14/851,283

(22) Filed: Sep. 11, 2015

(65) Prior Publication Data

US 2016/0076327 A1 Mar. 17, 2016

Related U.S. Application Data

(60) Provisional application No. 62/049,059, filed on Sep. 11, 2014.

(51) Int. Cl.
*E21B 31/20* (2006.01)
*E21B 23/04* (2006.01)

(52) U.S. Cl.
CPC ..... *E21B 31/20* (2013.01); *E21B 23/04* (2013.01)

(58) Field of Classification Search
CPC ..... E21B 31/00–31/20; E21B 23/04; E21B 23/00; E21B 23/02; E21B 23/01
See application file for complete search history.

(56) References Cited

U.S. PATENT DOCUMENTS 2,377,249 A * 5/1945 Lawrence ..... E21B 23/04 166/212
2,595,014 A 4/1952 Smith et al.
2,732,901 A 1/1956 Davis
2,734,581 A 2/1956 Bonner
2,747,673 A 5/1956 Lawrence
2,806,534 A 9/1957 Potts
2,818,926 A 1/1958 Webb
2,829,716 A * 4/1958 Stewart ..... E21B 31/107 166/98

(Continued)

FOREIGN PATENT DOCUMENTS

GB 2160241 A 12/1985

OTHER PUBLICATIONS

Examination Report filed in counterpart GB Application No. GB1516142.5 dated Jul. 10, 2017, 3 Pages.

(Continued)

*Primary Examiner* — George S Gray
(74) *Attorney, Agent, or Firm* — Blank Rome LLP

(57) ABSTRACT

A pulling tool deploys on a workstring to retrieving a well component, such as casing or a liner, stuck downhole. The tool has an anchor, a puller, and an implement. The implement is supported on the end of the puller and engages the component. Hydraulic pressure supplied downhole moves at least one puller piston coupled to the implement along a piston mandrel to pull the implement and component. An anchor mandrel coupled to the workstring and the piston mandrel anchors the pulling tool downhole. The anchor has slips disposed on the anchor mandrel that engage in surrounding casing when an anchor piston disposed on the anchor mandrel is hydraulically actuated with the communicated pressure.

25 Claims, 10 Drawing Sheets

(56) References Cited

U.S. PATENT DOCUMENTS

| | | | |
|---|---|---|---|
| 2,901,044 | A | 8/1959 | Arnold |
| 2,915,126 | A | 12/1959 | Potts |
| 2,965,177 | A | 12/1960 | Le Bus et al. |
| 2,978,030 | A | 4/1961 | Green et al. |
| 3,023,811 | A | 3/1962 | Green |
| 3,343,606 | A | 9/1967 | Dollison |
| 3,752,230 | A | 8/1973 | Bemat et al. |
| 5,070,941 | A | 12/1991 | Kilgore |
| 5,228,507 | A | 7/1993 | Obrejanu et al. |
| 5,361,834 | A | 11/1994 | Cox |
| 5,361,864 | A | 11/1994 | Cox |
| 5,370,180 | A | 12/1994 | Barbee |
| 5,398,753 | A | 3/1995 | Obrejanu et al. |
| 5,673,754 | A | 10/1997 | Taylor, Jr. |
| 6,745,842 | B2 | 6/2004 | Hughes et al. |
| 7,021,382 | B2 | 4/2006 | Angman et al. |
| 7,051,810 | B2 | 5/2006 | Clemens et al. |
| 7,367,397 | B2 | 5/2008 | Clemens et al. |
| 7,762,330 | B2 | 7/2010 | Saylor, III et al. |
| 7,874,364 | B2 | 1/2011 | Redlinger et al. |
| 8,365,826 | B2 | 2/2013 | Braddick |
| 2006/0037759 | A1* | 2/2006 | Braddick ..... E21B 7/061 166/382 |

OTHER PUBLICATIONS

TIW Corporation, "Casing Pulling Tool," Brochure, copyright 2014, dated Jun. 2014.

National Oilwell Varco, "Fishing Tools," Brochure, copyright 2010.

Weatherford, "Motorized Cutting Tool (MCT)," Brochure, copyright 2009.

Examination Report No. 1 in counterpart Australian Appl. 2015224487, dated Apr. 21, 2016, 5-pgs.

First Office Action in counterpart Canadian Appl. 2903669, dated Aug. 25, 2016, 3-pgs.

Examination Report in counterpart UK Appl. GB1516142.5, dated Apr. 5, 2016, 2-pgs.

* cited by examiner

DOWNHOLE CASING PULLING TOOL

BACKGROUND OF THE DISCLOSURE

Various types of fishing tools are used in wells to retrieve tools, tubulars, casing, or other components that become stuck in a well. In a typical technique, a drillpipe lowers a fishing tool into the well, and a grapple at the end of the tool engages the stuck component. An upward force on the drillpipe can then dislodge the component. In other techniques, jars that are hydraulically or mechanically powered can generate a jarring force to dislodge the stuck component.

For example, casing can become stuck in the well and may need to be retrieved. Traditional removal of the stuck casing is done either with pilot milling, pulling the casing free with jarring action, and then steady pulling applied through the drillpipe and the derrick's draw work. Milling is very time consuming and labor intensive. Additionally, using jars to deliver a retrieving force does not effectively retrieve mud stuck casing.

To deal with stuck casing, pulling tools or casing jacks, such as those available from HOMCO, Wilson Downhole, Houston Engineers, and others, have been used for some time in the past. As one example, a downhole force generating tool disclosed in U.S. Pat. No. 5,070,941 has an anchor and a piston/cylinder arrangement.

In another example, U.S. Pat. No. 8,365,826 discloses a hydraulically powered fishing tool that can be used to retrieve another tool or tubular stuck in a well. The fishing tool is supported in a well on a workstring and has a mandrel with a fishing device that engages stuck tool or tubular in the well. An anchor axially fixes the position of the tool in the well, and pistons disposed on the tool above the anchor move the mandrel so the fishing device on the end of the mandrel can be moved axially and can dislodge the stuck tool or tubular.

Older systems use anchoring and pulling that is much too weak to handle the pull loads experienced in wells today. Today, Wellbore A/S of Norway has developed a Down Hole Power Tool (DHPT) that uses the hydraulically powered fishing tool disclosed in U.S. Pat. No. 8,365,826 to retrieve casing. However, the fishing tool mentioned above has the anchor section disposed below the pull section. During operation, the pulling load must pass through the anchor section. Additionally, any torque that is needed to be transmitted downhole through the tool is done through the internal dimensions of the tool's members.

Although most stuck components, such as casing, can be dislodged using the above techniques and tools, some stuck components may require other means to be retrieved and may need techniques that avoid damaging the stuck component or other elements in the well.

The subject matter of the present disclosure is directed to overcoming, or at least reducing the effects of, one or more of the problems set forth above.

SUMMARY OF THE DISCLOSURE

A downhole pulling tool deploys on a workstring to retrieve a well component using an implement. The tool has a mandrel, an anchor, and a puller. The mandrel couples to the workstring, and the anchor is disposed on the mandrel. The mandrel can be a unitary component. For assembly purposes, however, the mandrel can include an anchor mandrel for the anchor coupled to a puller mandrel for the puller.

On the anchor, at least one slip is hydraulically actuated from an unset condition to a set condition. In this way, the at least one slip in the set condition can be wedged against a portion of the mandrel for engaging the anchor downhole in casing or tubing, for example. The puller, however, extends from the anchor and has at least one puller piston disposed on the mandrel. The at least one puller piston supports the implement and is hydraulically movable relative to the mandrel from an extended condition to a pulled condition.

The at least one slip in the set condition can extend outward from the mandrel and can retract inward toward the mandrel in the unset condition. For instance, the portion of the mandrel can define at least one ramped surface against which the at least one slip wedges.

The anchor has an anchor piston disposed on the mandrel. The anchor piston is hydraulically movable from a first condition to a second condition. According, the anchor piston in the second condition can wedge the at least one slip against the portion of the mandrel. To move the anchor piston, the mandrel defines a fluid passageway communicating with the workstring and conveying fluid to the anchor piston. A valve in the tool can then selectively communicate fluid conveyed through the fluid passageway to the anchor piston.

A number of biasing arrangements can be used to bias and control operation of the anchor, such as the operation of the at least one slip and the anchor piston. For example, the anchor piston can have at least one biasing element biasing the anchor piston to the first condition. The at least one biasing element can be a spring or the like having one portion engaged against the anchor mandrel and having an opposing portion engaged against the anchor piston.

In another example, the anchor piston can have at least one biasing element disposed between the anchor piston and the at least one slip. This biasing element can be a spring or the like having one portion engaged against the anchor piston and an opposing portion engaged against the at least one slip.

To help hold the at least one slip and control its movement relative to the mandrel, a cage can be disposed on the mandrel and can have the at least one slip movable therein. In this case, at least one biasing element can be engaged between the cage and the at least one slip and can bias the at least one slip to the unset condition. For example, the at least one biasing element can include first and second leaf springs affixed to the cage and engaged against ends of the at least one slip. Additionally, a biasing element, such as a spring or the like, can be engaged between the cage and the mandrel and can bias the at least one slip to the unset condition.

Similar to the operation of the anchor, the fluid passageway communicating in the mandrel with the workstring and conveying fluid can use the same or even a different valve for selectively communicating fluid conveyed through the mandrel to the at least one puller piston. Either way, the valve can include a seat disposed in the fluid passageway that is engageable by a deployed ball.

In one form of operation to retrieve a well component downhole with an implement, the well component is engaged with the implement on the pulling tool manipulated downhole with the workstring. The well component can be a stuck pipe or the like in the casing downhole, and the implement can be a fishing tool or the like.

With the implement engaged, the well component is then pulled by hydraulically moving at least one puller piston along a mandrel of the pulling tool in response to fluid pressure communicated down the workstring. The pulling tool is also anchored at a point uphole of the puller piston by hydraulically moving an anchor piston along the mandrel of the pulling tool in response to the communicated fluid pressure and wedging at least one slip outward from the mandrel with the movement of the anchor piston.

Before actually engaging the implement, however, some form of initial operations can be performed. In this case, the pulling tool can be initially manipulated downhole while at least temporarily holding the pulling tool in an unextended condition so that initial operations, such as cutting, can be performed. Eventually, the pulling tool can be released to extend to an extended condition so that the pulling operations can then be performed.

To at least temporarily holding the pulling tool in the unextended condition, a detachable coupling can be provided for the at least one puller piston to the mandrel. In an attached condition, the detachable coupling holds the at least one puller piston in the unextended condition on the mandrel, while the detachable coupling in a detached condition permits the at least one puller piston to extend on the mandrel. In one arrangement, the detachable coupling includes a collet disposed on the at least one puller piston and detachably engageable with at least one detent on the mandrel.

Another form of operation can also be used to retrieve a well component downhole with the implement on the pulling tool. As before, the well component can be engaged with the implement on the pulling tool manipulated downhole. Similarly, the well component can be pulled with the implement by hydraulically moving at least one puller piston along a mandrel of the pulling tool in response to communicated fluid pressure.

Anchoring the pulling tool at a point uphole of the puller piston can likewise use at least one slip wedged outward from the mandrel. However, in contrast to using an anchor piston to move the at least one slip, first movement of the at least one puller piston can be translated to second movement of the at least one slip for wedging in the casing. The first movement of the puller tool can permitted up to a first limit in a first direction so that over setting of the at least one slip is avoided.

In this way, the at least one slip is hydraulically actuated from the unset condition to the set condition by the at least one puller piston. To do this, the at least one slip can have a slip cage connected to the at least one puller piston. The slip cage can move on the mandrel with the movement of at least one puller piston and can force the at least one slip against a ramp surface on the mandrel.

To limit this movement, a detachable coupling can connect the slip cage to the at least one puller piston. The detachable coupling can translate first movement of the at least one puller piston up to the first limit in the first direction to second movement of the slip cage. Up to that limit then, the second movement of the slip cage can thereby wedge the at least one slip against the portion of the mandrel. Yet, the detachable coupling preferably does not translate movement of the puller piston past that limit to movement of the slip cage.

The detachable coupling can include a collet disposed on the at least one puller piston and detachably engageable with at least one detent on the slip cage. The at least one detent can use a first detent on the slip cage at least temporarily preventing passage of the collet in the first direction past the first detent. A second detent on the slip cage can prevent passage of the collet in a second opposite direction past the second detent.

To provide the desired release after operations, the detachable coupling can also translate third movement of the at least one puller piston in a second direction to fourth movement of the slip cage. This movement of the slip cage can remove the at least one slip from against the portion of the mandrel.

The foregoing summary is not intended to summarize each potential embodiment or every aspect of the present disclosure.

DETAILED DESCRIPTION OF THE DISCLOSURE

Figure 1:
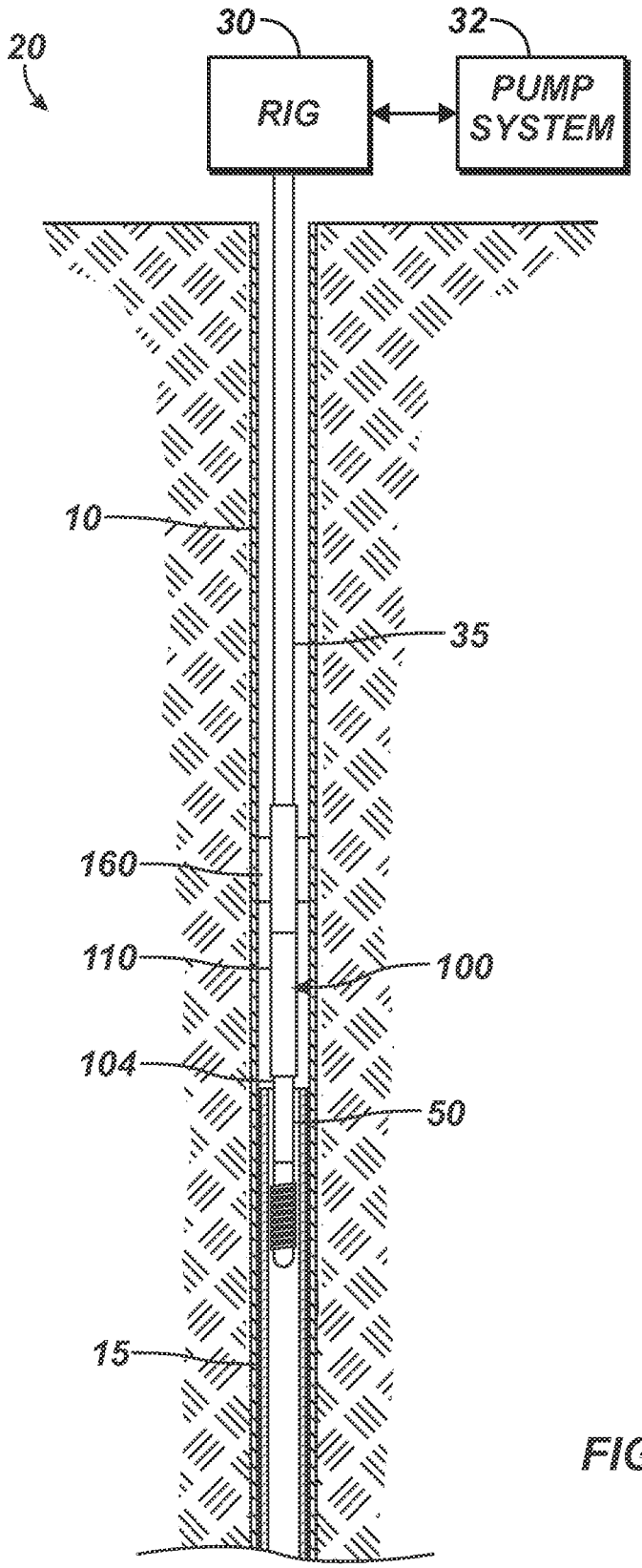
FIG. 1 illustrates a wellbore having a workstring deployed from a rig and having a pulling tool according to the present disclosure engaged with a stuck component.

When a well component 15 becomes stuck downhole, operators use a retrieval assembly 20 as shown in FIG. 1 to retrieve the well component 15. In general, the well component 15 can be casing, liner, pipe, tool, or the like that has become stuck downhole. Reference is made herein for convenience to stuck casing 15. Sections of stuck casing 15 to be pulled can be anywhere from 10 to 100-ft or more in length and may be stuck due to any number of reasons.

The retrieval assembly 20 has a pulling tool 100 according to the present disclosure. The pulling tool 100 may be used as a replacement for surface casing jack systems to retrieve stuck casing 15 or the like. In fact, the pulling tool 100 can be used to retrieve stuck casing 15 in applications where the drilling rig 30, platform, drillship, etc. or where the workstring 35 does not have sufficient capacity to pull the casing 15. Indeed, being able to remove casing 15 with the pulling tool 100 and without the need to perform milling operations can save rig time, reduce wear on rig equipment, and can eliminate swarf handling.

Operators deploy the pulling tool 100 on the workstring 35 into the wellbore from the rig 30, which has a pump system 32. Various types of implements 50 and fishing tools can be used depending on the implementation and the operation to be performed. Accordingly, the pulling tool 100 can be used with various types of implements 50, such as standard casing cutting and fishing tools. When the implement 50 is engaged with the casing 15, the pulling tool 100 is used to exert the pulling force required to retrieve the casing 15.

Figure 2A:
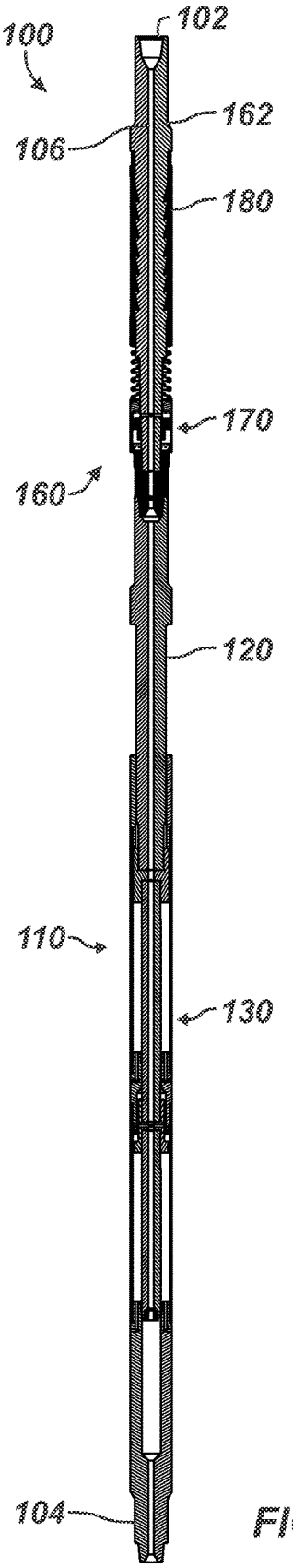
FIG. 2A illustrates a cross-sectional view of a pulling tool according to the present disclosure in an unstroked condition.
Figure 2B:
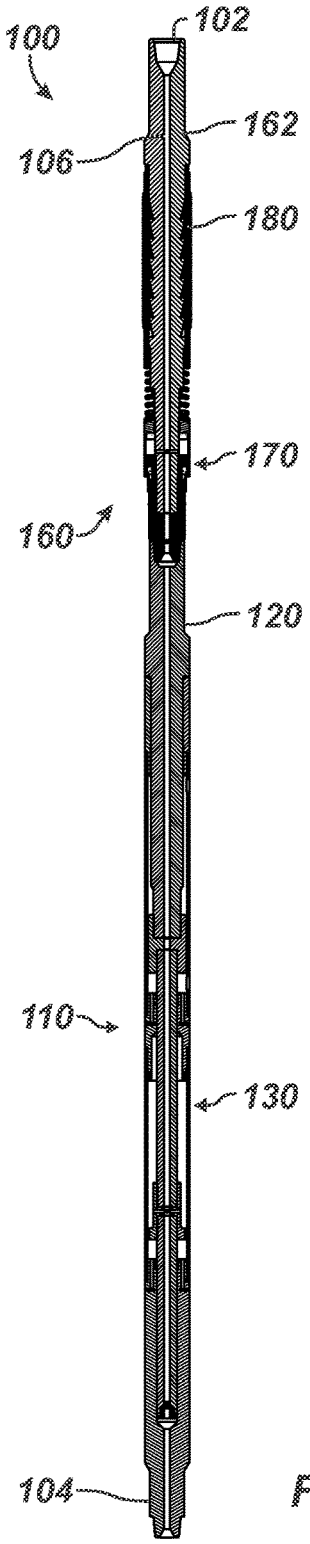
FIG. 2B illustrates a cross-sectional view of the pulling tool according to the present disclosure in a stroked condition.

The pulling tool 100 has an anchor 160 and a puller 110. The anchor 160 couples to the workstring 35, and the puller 110 extends further downhole from the anchor 160. At its distal end, the pulling tool 100 has the implement 50 supported on the puller 110 for engaging the well component 15. Further details of the tool 100 with its anchor 160 and puller 110 are shown in FIGS. 2A-2B.

In a pulling operation, for example, the pulling tool 100 is run on the workstring 35 downhole to a section of stuck casing 15 to be pulled uphole. The fishing tool 50 on the end of the pulling tool 100 is then located and tagged in the end of the stuck casing 15. For example, the fishing tool 50 may be a spear, although any suitable type of tool, such as a basket grapple, spiral grapple, die collar, tapered taps, etc., can be used depending on the implementation.

The fishing tool 50 is then set to engage the stuck casing 15. With the fishing tool 50 set, the pulling tool 100 is in an unstroked condition, such as shown in cross-section in FIG. 2A. In the unstroked condition, the puller 110 is stroked open with its piston(s) 130 extended on the puller's mandrel 120. The anchor's slips 180 are also retracted on the anchor's mandrel 162 so the pulling tool 100 can be manipulated downhole by the workstring 35. Fluid flow down the workstring 35 can pass through the pulling tool 100.

With the fishing tool 50 set as in FIG. 1, the anchor 160 on the pulling tool 100 is then set in the casing 10, and the puller 110 on the pulling tool 100 is stroked as the anchor 160 holds the tool 100 in place in the outer casing 10. In particular, hydraulic pressure is applied down the workstring 35 via the pump system 32 to the puller 110, which is already stroked to the open position. Applying the hydraulic pressure may involve closing a valve by deploying a ball, plug, dart, or the like down the workstring 35 to close off fluid flow through a ball seat and apply the pressure to the tool's internal components.

The applied pressure sets the anchor 160 in the outer casing 10 and strokes the piston(s) 130 of the puller 110 to a closed position. In the stroked condition as shown in FIG. 2B, the puller 110 is stroked closed so that the end 104 where the implement or fishing tool (50) couples can be pulled uphole toward the anchor 160, which has its slips 180 extended outward from the mandrel 162 to set the tool 100 in place downhole.

This stoked action of the tool 100 jacks (pulls) the stuck casing 15 of FIG. 1 uphole, as the pulling tool's stroke pulls the stuck casing 15 inside the outer casing 10. With the stroke complete, hydraulic pressure to the tool 100 from the workstring 35 is ceased, and the anchor 160 on the pulling tool 100 is unset by a straight pull up on the tool 100 by the workstring 35. Continued pulling then releases the stroke of the pulling tool 100, resetting the puller 110 to the extending condition for additional strokes. At this point, the pulling tool 100 can be reset to pull the stuck casing 15 again. If the stuck casing 15 has been sufficiently dislodged, then the assembly 20 can be retrieved along with the stuck casing 15 by tripping out the workstring 35.

On the disclosed pulling tool 100, the anchor 160 is disposed uphole from the puller 110, which means the major pull loads are taken by the heavy body of the puller 110 and not by the smaller inner dimensions of the anchor's components. The gives operators the ability to exert larger pulling forces due to the larger cross-section of the pulling mandrel 162 resulting from this arrangement. Additionally, when manipulating the tool 100 and the workstring 35, all downhole torque is done through the larger OD members of the puller 110.

For some example details on one implementation, the implement 50 can be a spear. The workstring 35 is rotated to set the spear 50 in the stuck casing 15, which can be a section of 9⅝-in. casing stuck in 13⅜-in. casing 10. When operated, the pulling tool 100 may be capable of generating a minimum 2,000,000-lbs downhole pulling force, can be about 50-ft long, can operate with maximum pressure of about 6,700-psi, and may have a 36-in. stroke length to pull the stuck casing 15. Other implementations and variables are possible as will be appreciated by one skilled in the art.

With an understanding of the operation of the pulling tool 100, discussion now turns to particular details related to the anchor 160 and the puller 110 of the disclosed tool 100.

Figure 3A:
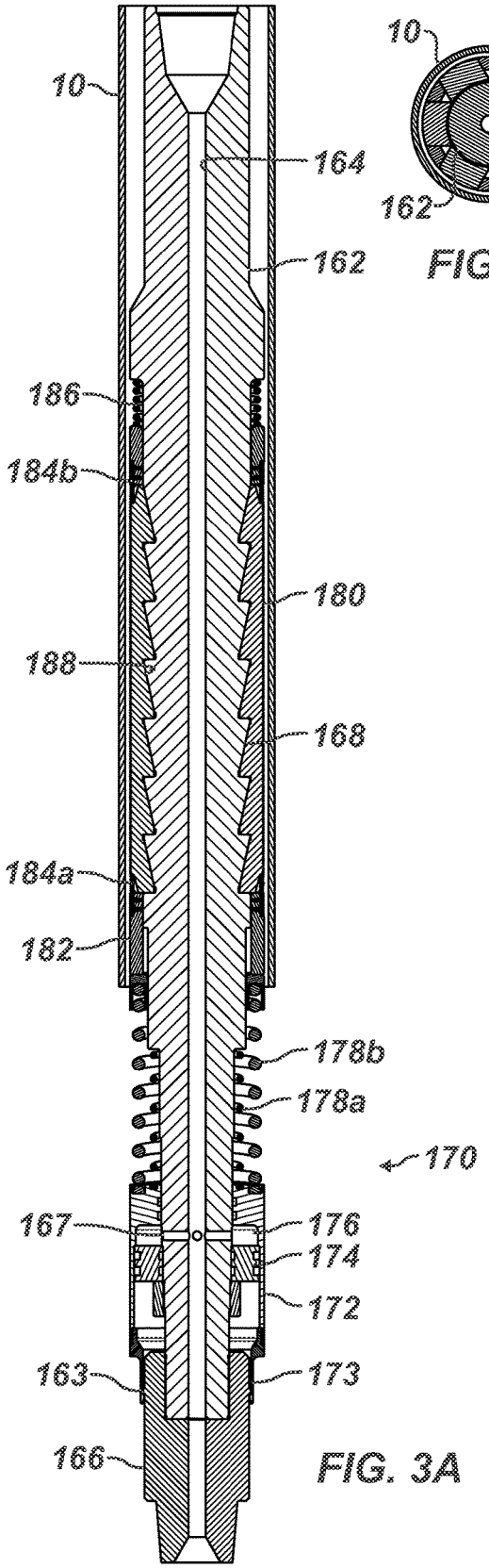
FIGS. 3A-3B illustrates cross-sectional and end-sectional views of the anchor section of the disclosed pulling tool in an unset condition.
Figure 3B:
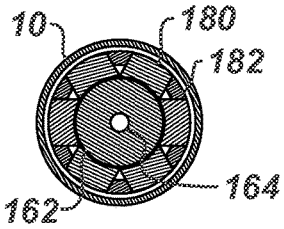
Figure 4A:
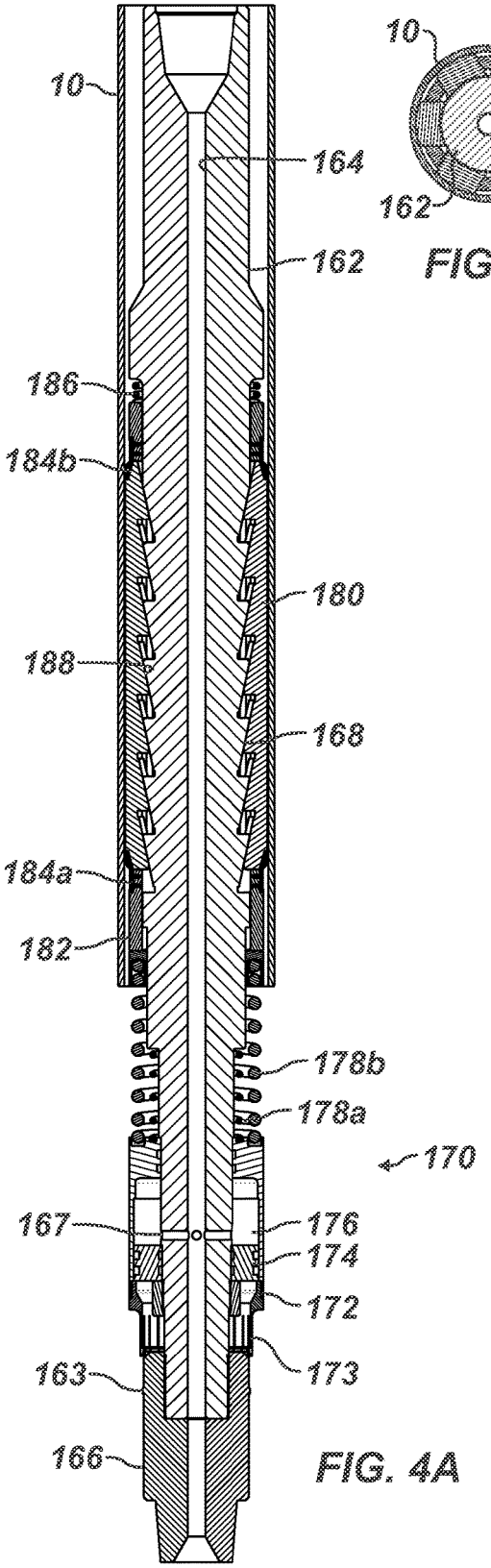
FIGS. 4A-4B illustrates cross-sectional and end-sectional views of the anchor section of the disclosed pulling tool in a set condition.
Figure 4B:
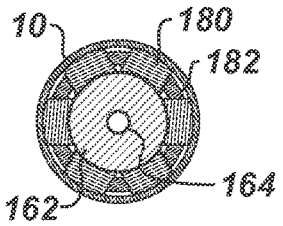

Looking first at the anchor 160, FIGS. 3A-3B illustrate cross-sectional and end-sectional views of the anchor 160 of the disclosed pulling tool 100 in an unset condition, whereas FIGS. 4A-4B illustrate cross-sectional and end-sectional views of the anchor 160 of the disclosed pulling tool 100 in a set condition.

The anchor 160 has an anchor mandrel 162 that can couple to the workstring (35) at an uphole end in a conventional manner and can form a part of the overall mandrel of the pulling tool (100). The anchor mandrel 162 defines a fluid passageway or bore 164 communicating with the workstring (35) and conveying fluid to various components of the tool (100) as discussed below.

The anchor 160 has an anchor piston 170 and at least one slip 180 disposed on the anchor mandrel 162. Preferably, multiple slips 180 are disposed around the circumference of the anchor mandrel 162 (See FIG. 3B). The slips 180 are hydraulically actuated from an unset condition (FIGS. 3A-3B) to a set condition (FIGS. 4A-4B) during operations discussed below. In the set condition, the anchor slips 180 wedge against portion of the anchor mandrel 162 and specifically wedge against ramps 168 on the surface of the mandrel 162.

As can be surmised, the slips 180 in the set condition can engage downhole by setting in the outer casing 10, for example. Preferably, the each slip 180 distributes the load of the pulling tool (100) along a length of the outer casing 10. In one implementation, for example, the slips 180 can be long rectangular bodies with a length of about 30-in.

As best shown in the end-sections of FIGS. 3B and 4B, the anchor slips 180 also preferably form an almost full circumference around the anchor 160. This allows for high anchoring loads and less hoop stress loading on the casing 10. For example, there may be preferably about six slips 180 around the diameter of the anchor mandrel 162 to form an almost full circle contact with the surrounding casing 10. This accommodates the high anchoring loads needed to pull stuck casing or the like.

The anchor piston 170 is hydraulically movable from a first condition (FIG. 3A) to a second condition (FIG. 4A) on the mandrel 162 relative to the slips 180 and slip cage 182. As shown, the cage 182 is disposed on the anchor mandrel 162 and supports the slips 180 movable on the anchor mandrel 162. In the first condition (FIG. 3A), the anchor piston 170 is moved away from the slips 180. In fact, a detachable coupling having a collet 173 on the piston's body 172 can engage a shoulder, rim, or detent 163 on the mandrel 162 to hold the anchor piston 170 in place.

In the second condition (FIG. 4A), fluid pressure communicated through the anchor bore 164 and cross-ports 167 enters a chamber 176 of the anchor piston 170. Pressure trapped in the chamber 176 by a seal block 174 pushes the anchor piston's body 172 toward the slips 180, unlatching the collet 173 from the detent 163. Pushing against the slips 180 via the cage 182, the anchor piston 170 extends the slips 180 outward from the anchor mandrel 162 to engage in the surrounding casing 10.

The slips 180 in the unset condition (FIGS. 3A-3C) are retracted inward toward the anchor mandrel 162, whereas the slips 180 in the set condition (FIGS. 4A-4C) are extended outward from the anchor mandrel 162. The anchor mandrel 162 defines at least one (and preferably multiple) ramped surfaces 168 against which complementary ramped surfaces 188 on the slips 180 extend and retract when pushed thereagainst by the anchor piston 170.

Figure 3C:
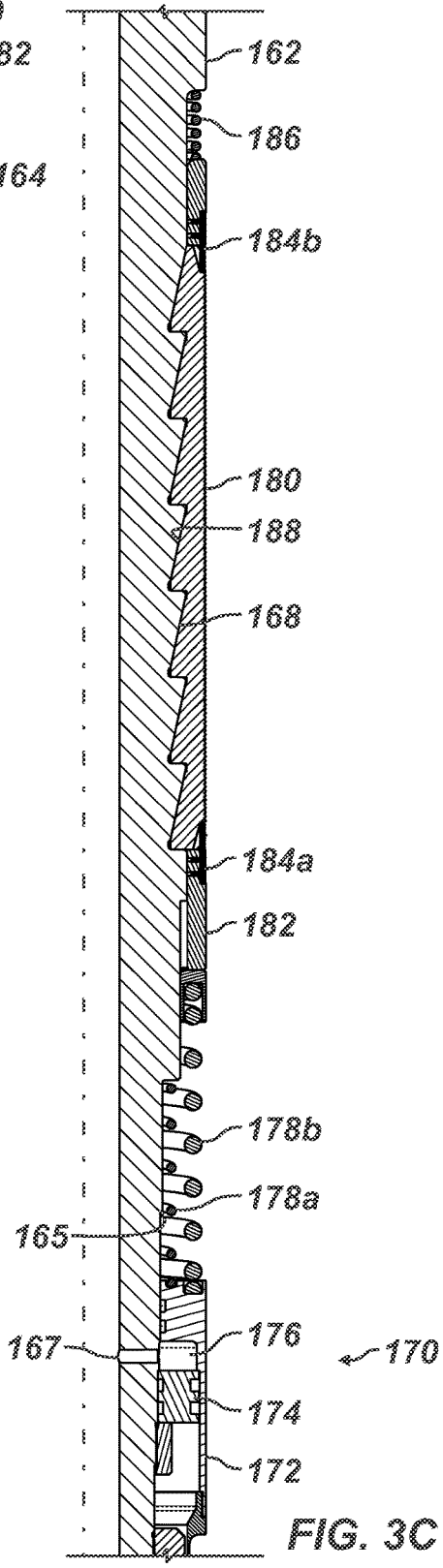
FIG. 3C illustrates a detailed cross-section of a slip and an anchor piston of the tool's anchor in the unset condition.
Figure 4C:
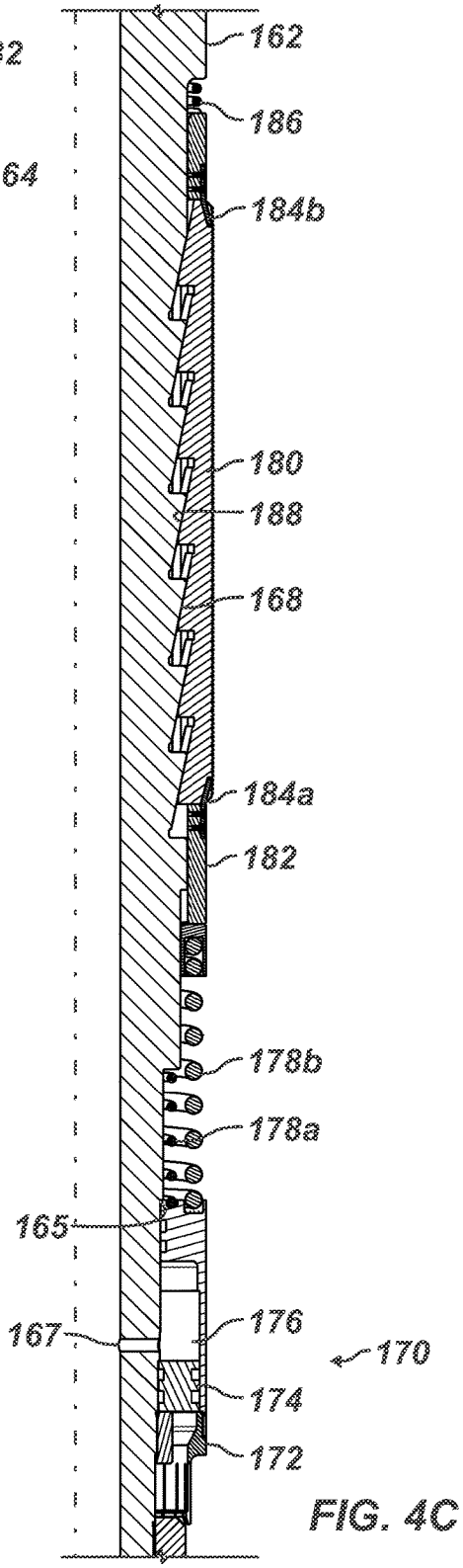
FIG. 4C illustrates a detailed cross-section of the slip and the anchor piston of the tool's anchor in the set condition.
Figure 5A:
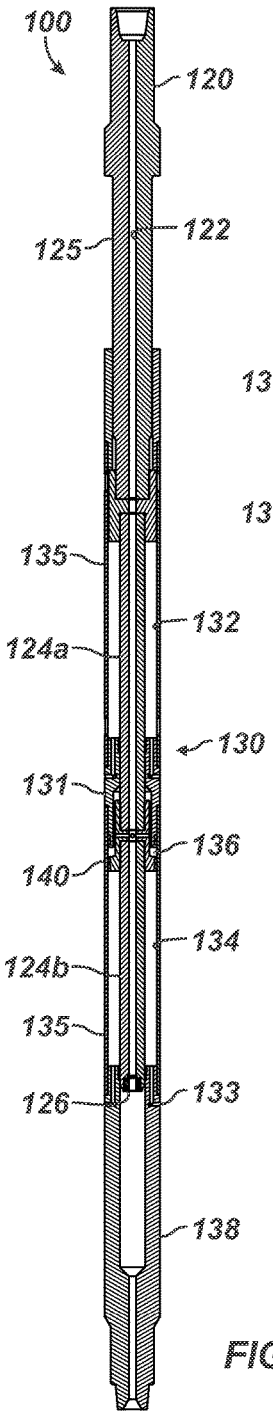
FIG. 5A illustrates an isolated cross-sectional view the power section of the disclosed pulling tool in the unstroked condition.
Figure 5B:
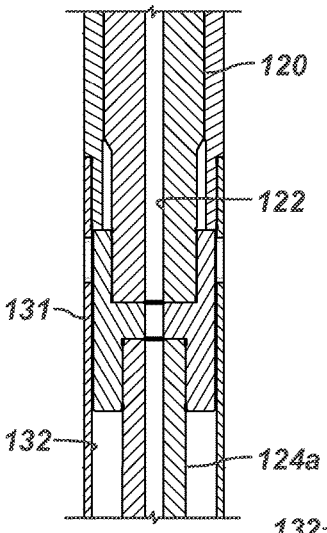
FIGS. 5B-5D show details of the unstroked power section in FIG. 5A.
Figure 5C:
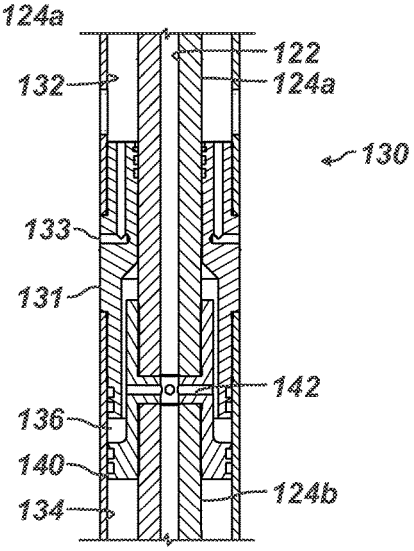
Figure 5D:
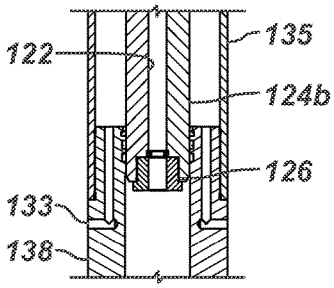

As best shown in the detailed views of FIGS. 3C and 4C, the anchor piston 170 has at least one first biasing element 178*a* biasing the anchor piston 170 to the first condition (FIG. 3C). This first biasing element 178*a* can be a retract spring having one portion engaged against a shoulder of the anchor mandrel 162 and having an opposing portion engaged against the anchor piston 170.

The anchor piston 170 also has at least one second biasing element 178*b* disposed between the anchor piston 170 and the slips 180. This second biasing element 178*b* can be a push spring having one portion engaged against the anchor piston 170 and having an opposing portion engaged against the slips 180 via the slip cage 182.

As also best shown in the detailed views of FIGS. 3C and 4C, the anchor slips 180 each have at least one third biasing element 184*a-b* biasing the slip 180 to its unset condition (FIG. 3C). These third biasing elements 184*a-b* can be leaf springs affixed to the cage 182 and engaged against ends of the slip 180. Finally, a return spring 186 may also be used at the uphole ends of the slips 180 to urge them to return to the unset condition (FIG. 3C).

The spring retainers 184*a-b* on each end of the slips 180 are multi-functional. The spring retainers 184*a-b* during operations not only hold each slip 180 in place, but they also assist in the return of the slips 180 to the reset positions. Additionally, the screws holding the spring retainers 184*a-b* on the split cage 180 are removable, which allows operators to easily replace slips 180 if worn or if new slips 180 are needed to accommodate a change in casing weights. This can be done on the rig floor if needed.

When internal pressure is applied, the anchor piston 170 moves up toward the slip cage 182 with the piston's force transferred to the cage 182 by the push spring 178*b*. Movement of the slip cage 182 forces the slips 180 out against the casing 10 by riding the slips' ramps 188 against the mandrel's ramps 168 and wedging the slips 180 against the mandrel 162. The movement of the anchor piston 170 is limited by a shoulder 165 on the mandrel 162. As can be seen, the push spring 178*b* allows for some play and adjustment between the components, which may be desirable during operations.

When pressure is released, the slips 180 may remain in their extended (catch) position due to the downward weight and the pull of the puller (110) and other components. The upward pull of the mandrel 162, however, relieves the wedging between the ramped surfaces 168/188 so the slips 180 can dislodge from inside of the casing 10 and release the anchor 160 to the reset position. The return spring 178*a* on the mandrel 162 also presses back against the anchor piston 170 (in the absence or release of pressure) to help move the piston 170 back in the reset position, which also helps place the slips 180 in their retracted (released) position as well. Finally, the other springs 184*a-b* and 186 can further assist with unsetting the slips 180.

Looking now at the puller 110, FIGS. 5A-5D show the puller 110 and sections thereof in the unstroked condition, while FIGS. 6A-6D show the puller 110 and sections thereof in the stroked condition.

The puller 110 has a puller mandrel 120 that couples at its uphole end to the anchor (160) and extends from the anchor mandrel (162). The puller mandrel 120 therefore forms part of the overall mandrel of the tool (100). At least one puller piston 130 is disposed on the puller mandrel 120 at at least one piston head 140 on the mandrel 120.

Although one puller piston 130 is shown in FIGS. 5A-6D, multiple pistons 130 can be stacked along the length of the puller 110 with an extended puller mandrel 120. In fact, the puller 110 may have a number of puller pistons 130 to increase the stroke power of the tool 100. In this way, the puller 110 can be configured for a particular pull load by adding or removing the pistons 130. For example, up to five pistons 130 can be used with the pulling tool 100, but if the pull loads are lower for whatever reasons, the pulling tool 100 can be modified at the rig or at the shop to have the desired number of pistons 130.

The puller piston 130 is hydraulically movable relative to the puller mandrel 120 from an extended condition (FIG. 5A) to a pulled condition (FIG. 6A) during operations as discussed herein. The puller piston 130 includes a body 131 defining an upper chamber 132 and a lower chamber 134 with an intermediate chamber 136 disposed between them. To form these chambers 132, 134, and 136, the body 131 of the piston 130 is disposed on the mandrel 120 and includes external members or cylinders 135 that transmit all the pull loads and torque downhole. To transmit torque from the mandrel 120 to the piston, the puller's mandrel 120 can have a torque transmission, splines, or hex drive 125 that engages the piston 130. An end body 138 is disposed at the distal end of the tool (i.e., past the last piston 130 if multiple pistons are used) for coupling to other components of the pulling tool (100), such as the implement or fishing tool (50).

The puller mandrel 120 defines a fluid passageway or bore 122 communicating with the workstring (35) via the anchor (160). A valve 126 in the puller bore 122 can selectively communicate fluid conveyed through the puller mandrel 120 to the puller piston(s) 130 and the anchor (160). For example, the valve 126 can be a ball seat to engage a dropped ball 128 deployed to the puller 110 during operations. Other types of valves, seats, or the like could be used.

In one example, a sleeve and port arrangement can be used for the valve 126 that is activated by a Radio Frequency Identification (RFID) tag or the like, using techniques known in the art. When an appropriate RFID tag is deployed to the tool 100, for example, the valve 126 can close to selectively communicate fluid through the puller mandrel 120 to the puller piston 130. In other examples, a mechanical sleeve using j-slots and the like can be used to mechanically open and close circulation to the puller piston 130.

Figure 6A:
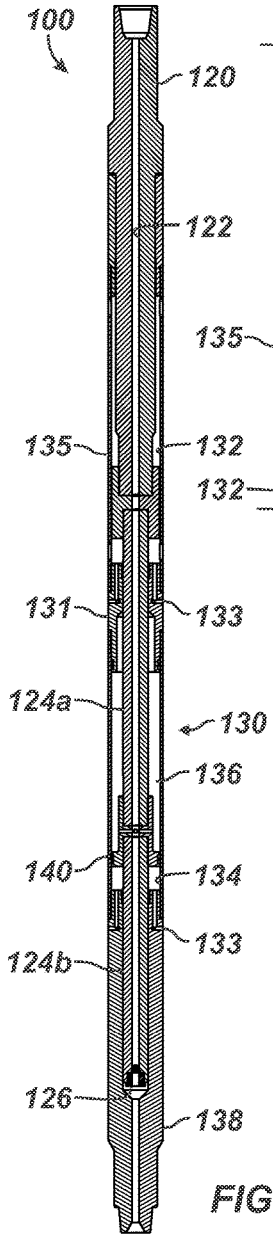
FIG. 6A illustrates an isolated cross-sectional view the power section of the disclosed pulling tool in the stroked condition.
Figure 6B:
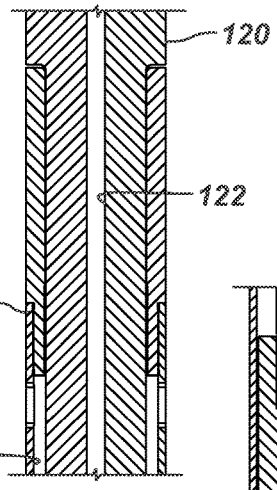
FIGS. 6B-6E show details of the stroked power section in FIG. 6A.
Figure 6C:
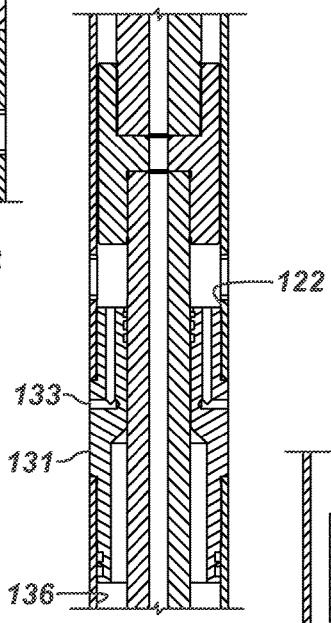
Figure 6D:
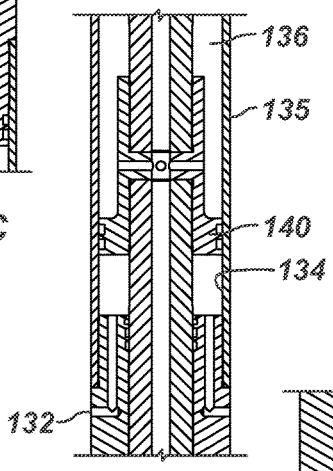
Figure 6E:
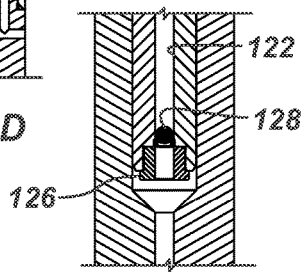

During operations when fluid pressure is pumped behind the closed valve 126, the hydraulic pressure actuates the puller piston(s) 130. In particular, the hydraulic pressure exits from the mandrel's bore 122 to the intermediate chamber 136 via cross-ports 142 at the piston head 140 (see FIG. 5C). Trapped pressure builds in the intermediate chamber 136 being sealed therein by seals against the exterior of the mandrel 120 and seals on the piston head 140. As shown in FIGS. 6C-6D, the intermediate chamber 136 expands as the upper and lower chambers 132 and 134 decrease in volume and vent through ports 133. As a result, the entire body 131 of the piston 130 as well as the end body 138 stroke up a length along the mandrel 120. This stroke length can be 36-in. for example.

The above pulling tool 100 may be deployed and manipulated downhole while the puller 110 is in an extended condition. Closing of fluid communication through the tool 100 and the build-up of hydraulic pressure would then activate the puller 110 to its pulled condition. It may be desirable, however, to deploy and manipulate the disclosed pulling tool 100 downhole while it is in its unextended condition. Accordingly, another pulling tool 100 according to the present disclosure shown in FIGS. 7A-7E has a detachable coupling 150 for this purpose.

This pulling tool 100 is similar to that disclosed above and has the anchor 160, the puller 110, and other similar components so that the same reference numerals are used for similar components. The pulling tool 110 includes the detachable coupling 150 between the anchor 160 and the puller 110. Using the detachable coupling 150, the pulling tool 110 can be held in an unextended condition when deployed downhole so various operations can be performed with other tools on the end of the pulling tool 100.

The detachable coupling 150 is disposed at the end of the pistons 130, such as the end that rides on a torque transmission, splines, or hex drive 125 of the puller's mandrel 120. The detachable coupling 150 as shown here includes a collet 137 that engages a detent 127, ridge, circumferential shoulder, etc. on the puller's mandrel 120. FIG. 7F shows a detail of the detachable coupling's collet 137 with the detent 127 for the disclosed pulling tool 100. As opposed to the collet and detent arrangement, other forms of detachable coupling 150 can be used, such as shear screws, shear pins, shear rings, snap rings, and the like.

Figures 7A, 7B, 7C:
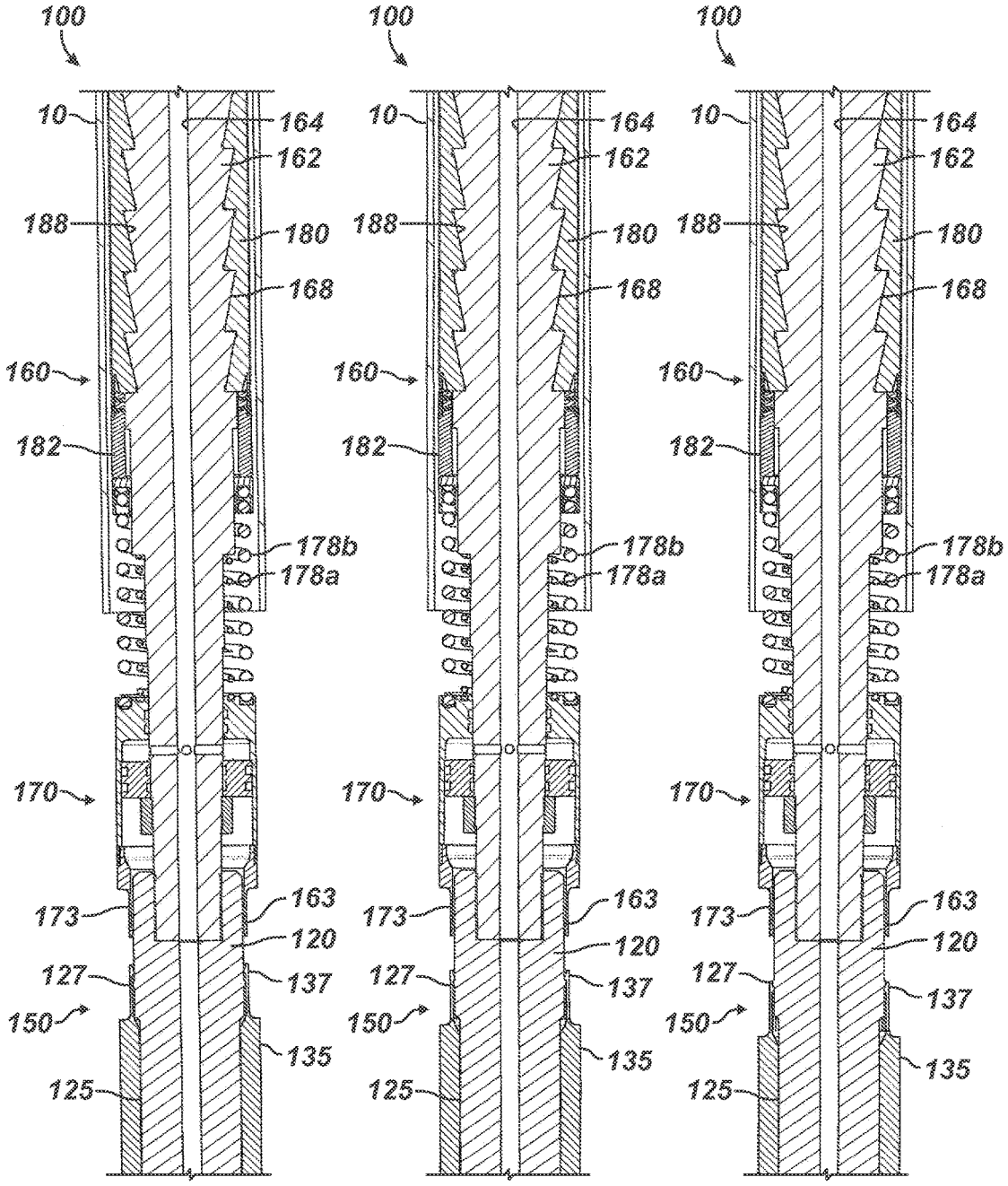
FIGS. 7A-7E illustrate cross-sectional views of portion of the disclosed pulling tool having a detachable coupling between the anchor and the puller during stages of operation.
Figure 7D:
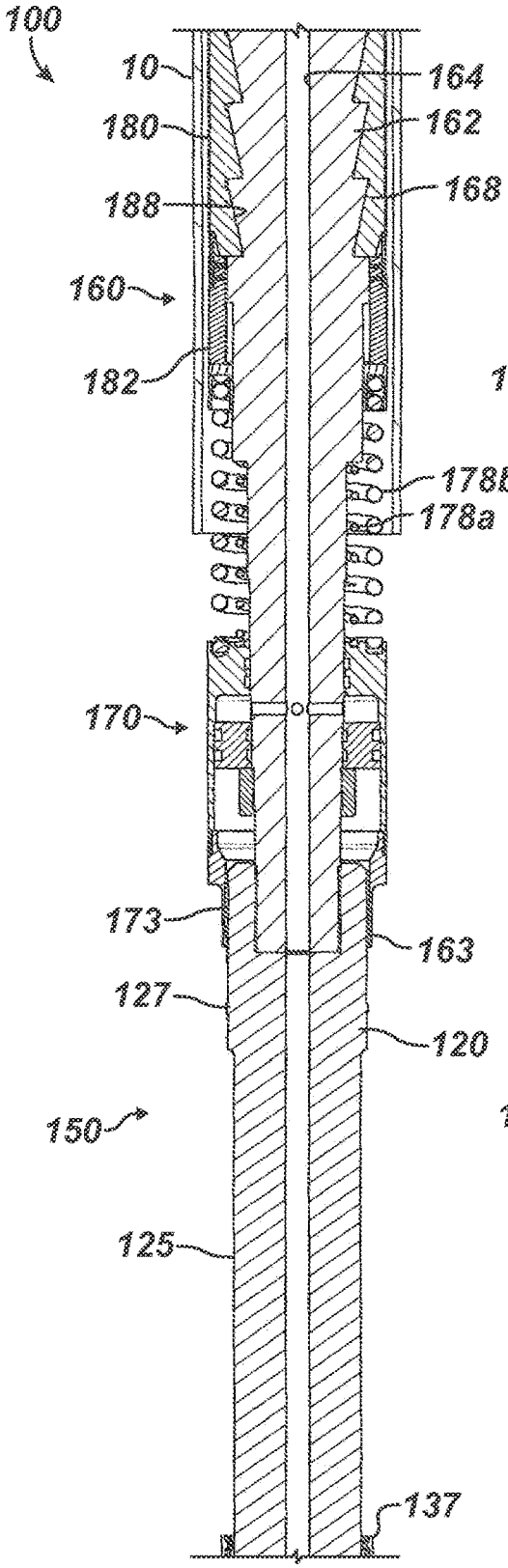

Assembled as shown in FIG. 7A, the detachable coupling 150 can be engaged so that the collet 137 fits over the mandrel's detent 127. During run in as shown in FIG. 7B, the weight of the tool 100 from the pistons 130 and other downhole components can engage the collet 137 on the detent 127. In this way, the pulling tool 100 can be held in an unextended condition when deployed (i.e., the pistons 130 do not extend along the puller mandrel 120 toward the end of the tool 110). After certain operations, such as engaging a spear, fishing tool, or other implement (not shown), operators can pull up on the pulling tool 110, causing the collet 137 to snap past the detent 127 as shown in FIG. 7C. With the detachable coupling 150 disengaged, the tool 110 can be extended (i.e., the pistons 130 can be stretched), as shown in FIG. 7D.

Figure 7E:
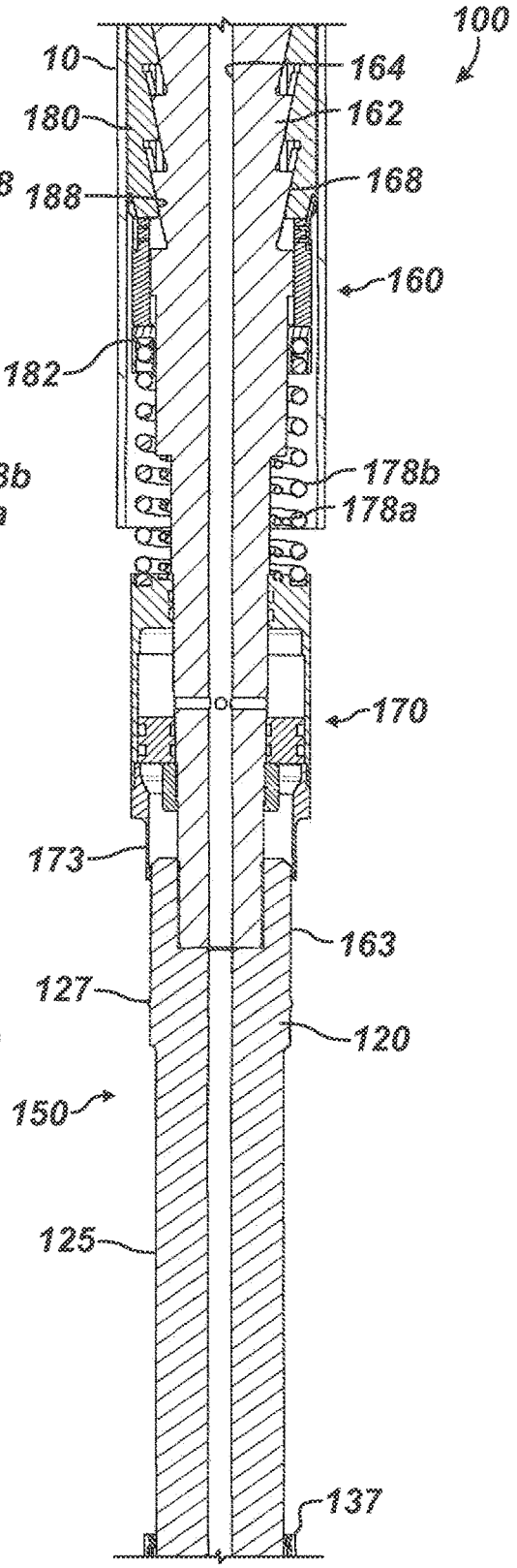
Figure 7F:
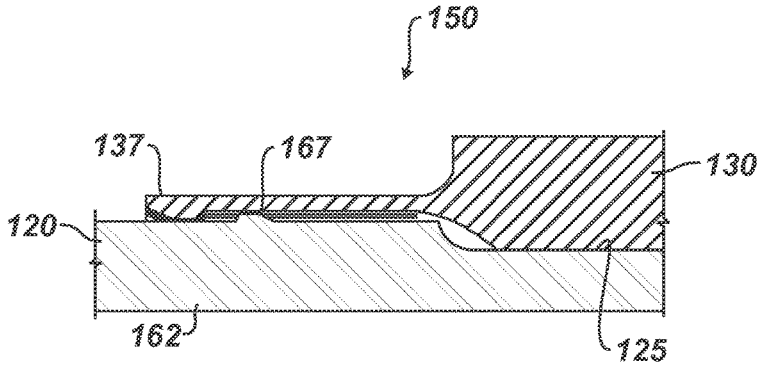
FIG. 7F shows a detail of one type of detachable coupling for the disclosed pulling tool.

Finally, subsequent operations of the pulling tool 100 can commence. For example, FIG. 7E shows setting of the anchor slips 180 by the anchor piston 170 once fluid flow has been diverted to actuate the tool 100. This operation can follow the procedures outlined previously in other embodiments so that they are not repeated here.

Figure 8:
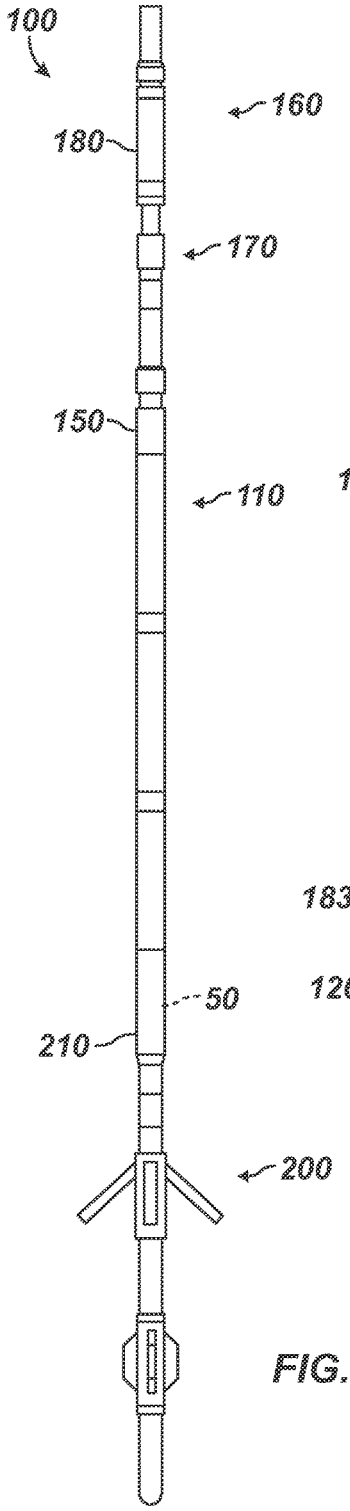
FIG. 8 shows the disclosed pulling tool with the detachable coupling in use with other downhole tools.

As noted above, the disclosed pulling tool 100 with the detachable coupling 150 to hold the tool 100 unextended can be used in other operations, which may use other downhole tools. As shown in FIG. 8, for example, the pulling tool 100 having the detachable coupling 150 can be configured with a cutter 200 extending from a coupling 210 to the spear 50 at the end of the puller 110. When deployed, the detachable coupling 150 maintains the puller 110 in the unextended condition. The detachable coupling 150 can hold the puller 110 in place until operations are done with spearing and cutting.

For instance, the cutter 200 can be operated using communicated fluid and a mud motor, although other types of cutters could be used. Operators can cut casing with the cutter 200. Then, by pulling up, operators can detach the coupling 150 so that the piston 130 and mandrel 120 can be stroked to prepare for activation and pulling of the newly cut casing section.

As will be appreciated, in addition to a cutter and cutting operation, any number of other tools and operates can benefit from the detachable coupling 150 that maintains the pulling tool 100 unextended during use.

Yet another pulling tool 100 according to the present disclosure shown in FIGS. 9A-9D has an alternative slip setting arrangement. This pulling tool 100 has similarities to the tools 100 disclosed above and has the anchor 160, the puller 110, and other similar components. Therefore, the same reference numerals are used for similar components. Instead of including an anchor piston 170 and associated components to actuate the slips 180, the anchor 160 for this tool 100 has the slip cage 182 engaged with the piston 130 of the puller 110, and the tool 100 uses the puller piston 130 to set the slips 180.

As only schematically shown here, the anchor's mandrel 162 couples to the puller's mandrel 120 to form the overall mandrel of the tool 100. An extension or sleeve 183 of the cage 182 extends from the anchor's slips 180 to the uppermost piston 130. A detachable coupling 139 connects the piston's end to the cage's sleeve 183, which has detents 187. As shown, the detachable coupling 139 includes a collet that can telescopically fit over the cage's sleeve 183 to engage and disengage relative to the sleeve's detents 187. A reverse arrangement could also be used.

Figure 9E:
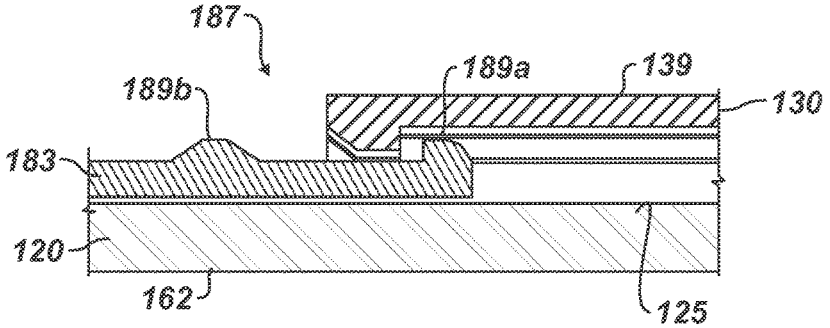
FIG. 9E shows a detail of the alternative slip setting arrangement.

FIG. 9E shows a detail of the collet 139 and detents 187. The collet 139 has a hard shoulder that can engage a fixed shoulder detent 189*a*, preventing telescopic extension between the piston 130 and the cage sleeve 183 and tending to hold the collet 139 and sleeve 183 together axially. The distal end of the collet 139, however, can engage against an intermediate detent 189*b* on the cage's sleeve 183. When the collet 139 is moved telescopically toward the intermediate detent 189*b* from the position shown in FIG. 9E, the piston 130 can tend to push the cage's sleeve 183 along with it, at least until the collet 139 can snap past and over the intermediate detent 189*b*. The reverse is also true when the collet 139 is moved back over the intermediate detent 189*b* in the opposite direction.

Figures 9A, 9B, 9C, 9D:
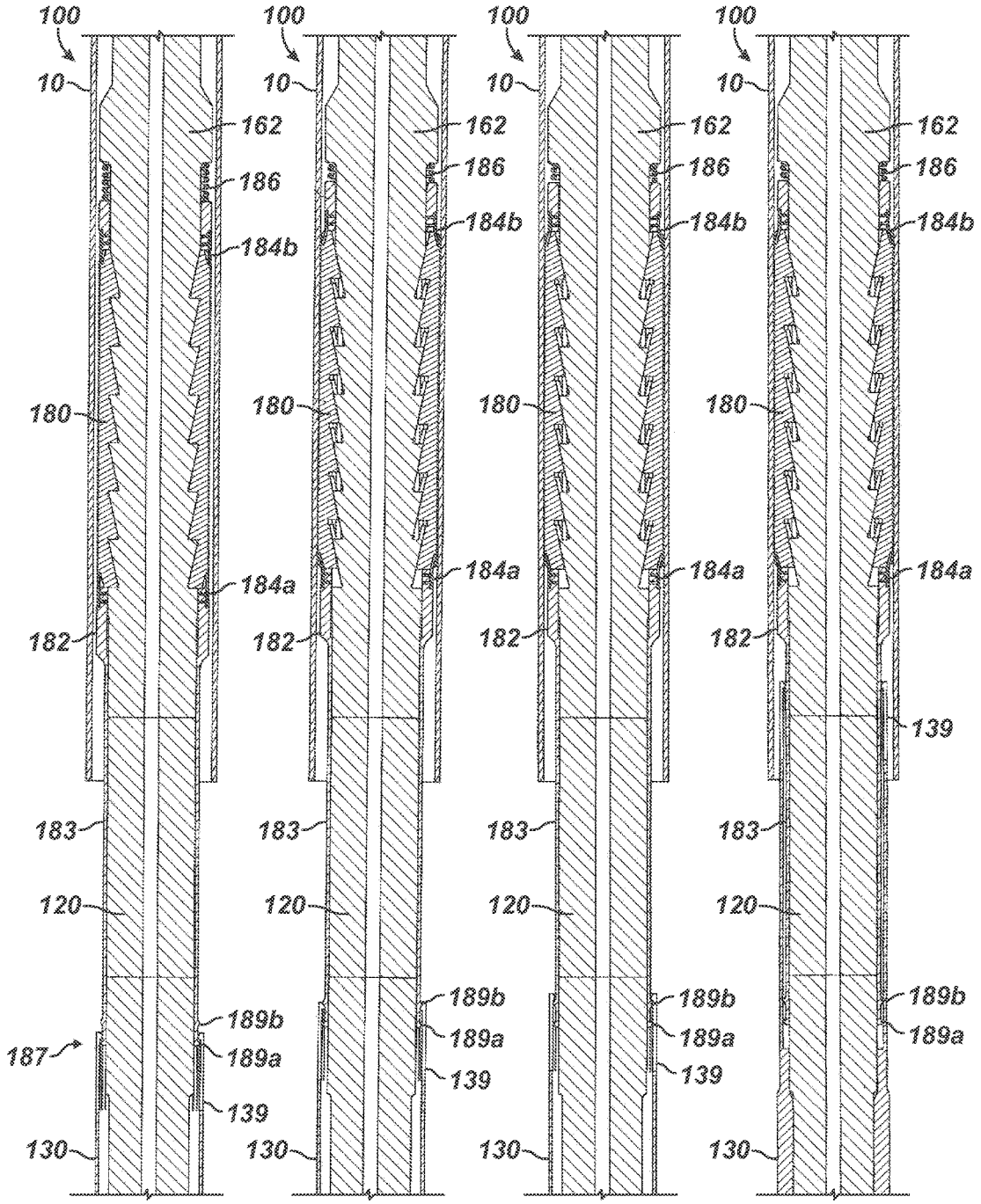
FIGS. 9A-9D illustrate cross-sectional views of portion of the disclosed pulling tool having an alternative slip setting arrangement between the anchor and the puller during stages of operation.

During run in as shown in FIG. 9A, the piston's collet 139 is fixed at the detents 187, and more particularly, the collet 139 can engage the hard shoulder detent 189*a* preventing telescopic extension between the sleeve 183 and piston 130. When pulling operations are to commence (e.g., an implement has been affixed to stuck casing), operators can initiate the piston 130 of the pulling tool 100 by diverting communicated fluid to the piston 130. The collet 139 at the end of the piston 130 can then move upward a slight movement before engaging against the intermediate detent 189*b*.

Should operation of the tool 100 fail at this point for whatever reason, the small amount of play will enable operators to stop activation of the tool 100 and release the tool 100 using the slack provided by the offset in the detents 189*a-b*. For example, if the fishing implement (50) does not move the stuck casing as the piston 130 is first activated, the offset in the movement can allow operators to pull up on the tool 100 even after starting the stroke of the piston 130.

Nevertheless, activation of the piston 130 pushes the collet 139 against the intermediate detent 189*b* as shown in FIG. 9B. In this way, the piston's movement translates to movement of the cage's sleeve 183. As a result, the cage 182 moves and pushes the anchors 180 against the ramps 168 on the anchor's mandrel 162, tending to wedge and set the slips 180.

Eventually, as shown in FIG. 9C, enough setting of the anchor's slips 180 is reached, and the collet 139 snaps past the intermediate detent 189*b*. At this point, continued movement of the piston 130 does not translate to the anchor's slips 180 so that they are not overset. Further activating of the piston 130, however, tends to mechanically pull the mandrel 160 toward the pistons 130, wedging the anchor slips 180, while the pistons 130 pull against the implement and the stuck casing disposed at the end of the tool 100. Further retraction of the piston 130 along the cage's sleeve 183 can continue as shown in FIG. 9D during this pulling activity without the piston's telescopic movement translating to the cage 182.

Unsetting the pulling tool 100 involves a reverse operation. While fluid flow is ceased, operators pull up on the pulling tool 100. The anchor mandrel 162 can move relative to the slips 180 biting into the casing 10 so that the ramped surfaces 168 and 188 can unwedge. The springs 184*a-b* and 186 (if present) can tend to retract the unwedged slips 180. The piston's collet 139 can slide freely along the cage's sleeve 183 as the piston 130 tends to extend along the puller mandrel 120. Eventually, the collet 139 can reach the intermediate detent 189*b* and tend to further pull the cage 182 to unset the slips 180. Finally, the collet 139 can reach the hard detent 189*a* that pulls the cage 182 to its initial, unset condition. Repeat pulling operations can then be performed if necessary.

The foregoing description of preferred and other embodiments is not intended to limit or restrict the scope or applicability of the inventive concepts conceived of by the Applicants. As disclosed above, certain components have been disclosed as being modular in nature, which can facilitate assembly and use. This is not strictly necessary as certain components can be combined and integrated with one another to construct the disclosed tool. In this regard, the anchor mandrel and the puller mandrel need not be separately coupleable elements but may in fact be constructed as an integral mandrel component. This and other modifications will be appreciated by one skilled in the art having the benefit of the present disclosure.

It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole pulling tool for deploying on a workstring and retrieving a well component using an implement, the tool comprising:

a mandrel coupleable to the workstring;

an anchor disposed on the mandrel and having at least one slip, the at least one slip hydraulically actuated from an unset condition to a set condition, the at least one slip in the set condition wedged against a portion of the mandrel and supporting the anchor downhole; and a puller extending from the anchor and being anchored at a point uphole by the anchor, the puller having at least one puller piston disposed on the mandrel, the at least one puller piston supporting the implement and being hydraulically movable relative to the mandrel from an extended condition to a pulled condition.

2. The tool of claim 1, wherein the mandrel comprises an anchor mandrel for the anchor coupled to a puller mandrel for the puller.

3. The tool of claim 1, wherein the at least one slip in the set condition extends outward from the mandrel and in the unset condition retracts inward toward the mandrel; and wherein the portion of the mandrel defines at least one ramped surface against which the at least one slip wedges.

4. The tool of claim 1, wherein the anchor comprises an anchor piston disposed on the mandrel and hydraulically movable from a first condition to a second condition, the anchor piston in the second condition wedging the at least one slip against the portion of the mandrel.

5. The tool of claim 4, wherein the mandrel defines a fluid passageway communicating with the workstring and conveying fluid to the anchor piston; and wherein the tool comprises a valve for selectively communicating fluid conveyed through the fluid passageway to the anchor piston.

6. The tool of claim 4, wherein the anchor piston comprises at least one biasing element biasing the anchor piston to the first condition, the at least one biasing element having one portion engaged against the mandrel and having an opposing portion engaged against the anchor piston.

7. The tool of claim 4, wherein the anchor piston comprises at least one biasing element disposed between the anchor piston and the at least one slip, the at least one biasing element having one portion engaged against the anchor piston and having an opposing portion engaged against the at least one slip.

8. The tool of claim 1, wherein the at least one slip comprises a cage disposed on the mandrel, the at least one slip being movable relative to the cage.

9. The tool of claim 8, further comprising at least one biasing element engaged between the cage and the at least one slip and biasing the at least one slip to the unset condition.

10. The tool of claim 8, further comprising a biasing element engaged between the cage and the mandrel and biasing the at least one slip to the unset condition.

11. The tool of claim 1, wherein the mandrel defines a fluid passageway communicating with the workstring and conveying fluid, and wherein the tool comprises a valve for selectively communicating fluid conveyed through the mandrel to the at least one puller piston.

12. The tool of claim 11, wherein the valve comprises a seat disposed in the fluid passageway and selectively engageable by a ball deployed in the workstring.

13. The tool of claim 1, further comprising a detachable coupling of the at least one puller piston to the mandrel, the detachable coupling in an attached condition holding the at least one puller piston in an unextended condition on the mandrel, and the detachable coupling in a detached condition permitting the at least one puller piston to extend on the mandrel.

14. The tool of claim 13, wherein the detachable coupling comprises a collet disposed on the at least one puller piston and detachably engageable with at least one detent on the mandrel.

15. The tool of claim 1, wherein the at least one slip is hydraulically actuated from the unset condition to the set condition by the at least one puller piston.

16. The tool of claim 15, wherein the at least one slip comprises a cage connected to the at least one puller piston, the cage moving on the mandrel with the movement of at least one puller piston and wedging the at least one slip against the portion of the mandrel.

17. The tool of claim 16, further comprising a detachable coupling connecting the cage to the at least one puller piston, the detachable coupling translating first movement of the at least one puller piston up to a first limit in a first direction to second movement of the cage, the second movement of the cage wedging the at least one slip against the portion of the mandrel.

18. The tool of claim 17, wherein the detachable coupling translates third movement of the at least one puller piston in a second direction to fourth movement of the slip cage, the fourth movement of the slip cage removing the wedging of the at least one slip from against the portion of the mandrel.

19. The tool of claim 17, wherein the detachable coupling allows the first movement of the at least one puller piston past the first limit in the first direction to not translate to the second movement of the cage.

20. The tool of claim 17, wherein the detachable coupling comprises a collet disposed on the at least one puller piston and detachably engageable with at least one detent on the cage.

21. The tool of claim 20, wherein the at least one detent comprises: a first detent on the cage at least temporarily preventing passage of the collet in the first direction past the first detent; and a second detent on the cage preventing passage of the collet in a second opposite direction past the second detent.

22. A method of retrieving a well component downhole with an implement, the method comprising:

engaging the well component with the implement on a pulling tool manipulated downhole on a workstring;

pulling the well component with the implement by hydraulically moving at least one puller piston along a mandrel of the pulling tool in response to fluid pressure communicated down the workstring; and anchoring the pulling tool at a point uphole of the at least one puller piston by hydraulically moving an anchor piston along the mandrel of the pulling tool in response to the communicated fluid pressure and wedging at least one slip outward from the mandrel with the movement of the anchor piston.

23. The method of claim 22, comprising initially manipulating the pulling tool downhole on the workstring while at least temporarily holding the pulling tool in an unextended condition; and performing an initial operation downhole.

24. The method of claim 23, further comprising releasing the pulling tool from the unextended condition to extend to an extended condition before performing the pulling operation.

25. The method of claim 22, wherein anchoring the pulling tool at the point uphole of the at least one puller piston with the at least one slip wedged outward from the mandrel comprises translating first movement of the at least one puller piston up to a first limit in a first direction to second movement of the at least one the slip.

* * * * *